US011952737B2

(12) United States Patent
McCormack et al.

(10) Patent No.: US 11,952,737 B2
(45) Date of Patent: Apr. 9, 2024

(54) COUPLER FOR COUPLING AN ATTACHMENT TO A DIPPER ARM

(71) Applicant: Geith International Limited, Dublin Swords (IE)

(72) Inventors: Martin McCormack, Dublin Swords (IE); Tony McKeown, Drogheda (IE)

(73) Assignee: Geith International Limited, Dublin Swords (IE)

( * ) Notice: Subject to any disclaimer, the term of this patent is extended or adjusted under 35 U.S.C. 154(b) by 396 days.

(21) Appl. No.: 17/416,476

(22) PCT Filed: Dec. 20, 2019

(86) PCT No.: PCT/EP2019/086854
§ 371 (c)(1),
(2) Date: Jun. 19, 2021

(87) PCT Pub. No.: WO2020/128075
PCT Pub. Date: Jun. 25, 2020

(65) Prior Publication Data

US 2022/0042274 A1 Feb. 10, 2022

(30) Foreign Application Priority Data

Dec. 21, 2018 (GB) ..... 1821009

(51) Int. Cl.
*E02F 3/36* (2006.01)

(52) U.S. Cl.
CPC ..... *E02F 3/3618* (2013.01); *E02F 3/3622* (2013.01); *E02F 3/365* (2013.01)

(58) Field of Classification Search
None
See application file for complete search history.

(56) References Cited

U.S. PATENT DOCUMENTS 5,549,440 A * 8/1996 Cholakon ..... E02F 3/3663 37/468
2016/0002877 A1 1/2016 Pesch
(Continued)

FOREIGN PATENT DOCUMENTS

AU 2012201264 A1 * 9/2013 ..... E02F 3/36
AU 2021201264 A1 3/2021
(Continued)

*Primary Examiner* — Daniel J Wiley
(74) *Attorney, Agent, or Firm* — Schmeiser, Olsen & Watts LLP

(57) ABSTRACT

A quick hitch coupler for coupling an attachment to a dipper arm of an excavator, the quick hitch coupler comprising:

(a) a body member adapted for coupling to the dipper arm, (b) a fixed engaging jaw mounted on the body member for engaging a first one of a pair of coupling pins mounted on the attachment, (c) a movable engaging jaw mounted on the body member for engaging a second one of the pair of coupling pins of the attachment, the movable engaging jaw being movable between an engaged state with the movable engaging jaw engaging the second coupling pin while the fixed engaging jaw engages the first coupling pin for coupling the attachment to the coupler, and a disengaged state for disengaging the second coupling pin, (d) a latch co-operable with the fixed engaging jaw for retaining the first coupling pin of the attachment engaged in the fixed engaging jaw the latch being alternately operable in a latched state co-operating with the fixed engaging jaw for retaining the first coupling pin in the fixed engaging jaw, and an unlatched state for releasing the first coupling pin from the fixed engaging jaw, (e) an urging means for urging the latch into the latched state, (f) a release block being movable on (and relative to) a guide, the release block being movable on the guide between a non-active position in which the latch remains in the latched state and an active position where the release block abuts against the latch to move the latch from the latched state to the unlatched state against the urging action of the urging means, (g) a drive means generating an amount of displacement:

(i) for moving the movable engaging jaw from the engaged state to the disengaged state, and (ii) for moving the release block on the guide from the non-active position to the active position.

The drive means generates an amount of displacement for moving the movable engaging jaw but the release block is not moved and a second stage where the drive means (Continued)

generates an amount of displacement for moving the movable engaging jaw above a threshold amount where the release block is moved.

19 Claims, 11 Drawing Sheets

(56) References Cited

U.S. PATENT DOCUMENTS

| | | | | |
|---|---|---|---|---|
| 2017/0067223 | A1 | 3/2017 | Tsukada | |
| 2020/0040546 | A1* | 2/2020 | Jeon | E02F 3/365 |
| 2020/0048860 | A1* | 2/2020 | Jang | F15B 15/06 |
| 2020/0217040 | A1* | 7/2020 | Hill | E02F 3/3654 |
| 2021/0131057 | A1* | 5/2021 | Miller | E02F 3/3618 |

FOREIGN PATENT DOCUMENTS

| | | | |
|---|---|---|---|
| KR | 101651856 | B1 | 9/2016 |
| WO | 2018056841 | A1 | 3/2018 |

* cited by examiner

COUPLER FOR COUPLING AN ATTACHMENT TO A DIPPER ARM

FIELD OF THE INVENTION

The present invention relates to a coupler for coupling an attachment to a dipper arm of a machine for example of an excavator, digger or the like, and in particular a back actor arm.

BACKGROUND TO THE INVENTION

Couplers similar to the type which are the subject of the invention are known. For example International patent publication WO 2018/056841 describes a coupler where a protruding finger 71 releases a latch 67. The finger 71 is fixed to the cylinder 27 so this raises issues described below. European patent EP1637659 to Geith International describes a coupler and a control system for the coupler. Such couplers have a fixed jaw (typically with a lock/latch) for engaging with a first coupling pin on an attachment/attachment such as a bucket. They also have a second moving jaw which engages with a second coupling pin on the attachment. Such couplers and control systems are designed to ensure that an attachment, such as a bucket, is not accidentally released from the arm of a machine. It will be appreciated that if an attachment is released by mistake, or, in the event of a machine failure such as a hydraulic failure, it can fall from the machine causing damage and/or injury. The coupler and/or control system of European patent EP1637659 are designed to prevent such accidental release. The control system of this patent will not allow release of the attachment if the coupler is not in one or more predetermined positions relative to the arm. Furthermore a lock/latch associated with the fixed jaw locks a first coupling pin into the fixed jaw. This lock/latch can only be released when the coupler is not in one or more predetermined positions relative to the arm and after the second movable jaw of the coupler has released the second pin.

Notwithstanding the greatly improved safety associated with the coupler and control system of European patent EP1637659, circumstances can arise where an attachment is released unintentionally.

To release the attachment from a coupler controlled by a control system the operator will need to comply with the requirements of the control system, for example by having the coupler/attachment curled in towards the arm. This position is often referred to as a crowd position.

Once the operator has complied with the requirements of any control system they can start the attachment release process. The release process is the reverse of the engaging process and firstly moves the movable jaw to release the second pin, while the first pin remains within the first jaw. Then after the second pin is released the mechanism operates to release the first pin by opening the latch/lock. Typically this is done with an actuator that in sequence first moves the movable jaw and then secondly unlatches the latch on the fixed jaw. Because of the mode of operation of the control system, after unlatching of the latch on the fixed jaw, the first pin still sits within the fixed jaw so that the bucket is retained by the fixed jaw and does not fall out. For example the control system may only allow unlatching the latch on the fixed jaw in a position and/or an orientation of the coupler where the first pin is seated within the fixed jaw so that the attachment is held from falling by the first pin, typically such an orientation is where the fixed jaw faces upwardly, for example in a crowd position of the attachment.

This means the first pin is held by the weight of the attachment in the upward facing jaw. The operator can then move the arm of the machine and thus the coupler to unseat the first pin from the fixed jaw for full release of the attachment. This is normal intentional release.

But circumstances can arise where, when operating such a coupler to pick up an attachment, an operator of a machine to which the coupler is attached engages the first coupling pin in the fixed jaw, but, when moving the second moving jaw to engage with the second coupling pin, they miss the second coupling pin. Sometimes in such circumstances the second moving jaw moves past the second coupling pin.

When the operator realizes that they have not engaged with the second coupling pin, they need to reverse the coupling procedure/start an uncoupling/release process before they can make another attempt to engage the coupler with the coupling pins of an attachment. The first action in the uncoupling procedure is the opening movement/retraction of the movable jaw. However, where the second pin has been missed, this first action can result in the movable jaw being pulled back causing the rear of the movable jaw to abut against the second pin and in some instances causing the rear of the movable jaw to jam against the second pin.

This in turn causes an attachment ejection effect. The force of the movable jaw retracting can (unintentionally on the part of the user) impart a force on the second pin and thus also on the attachment which in turn imparts a force on the first pin urging it out of the fixed jaw. Secondly when the actuator moves sufficiently to unlatch the latch on the fixed jaw the force of the movable jaw retracting (and being caught on the second pin) causes the first pin to be ejected from the fixed jaw and the attachment then falls off the coupler.

In summary the fact that the second pin is missed by mistake in a closing action of the movable jaw where the movable jaw moves past the second pin, can mean that upon a subsequent opening action the opening action can cause (i) the rear side of the movable jaw to catch against the second pin so that the opening action is now pushing the second pin, and (ii) the latch on the fixed jaw to open with the consequence of items (i) and (ii) being that the opening action pushes the attachment out of the coupler.

This is undesirable, as even though the operator knows they are undertaking an attachment release procedure, they are not expecting the attachment to fall out of the coupler as in normal circumstances the attachment would be retained by the coupler (as described above). This is because the attachment falling out of the coupler is in contrast to the normal situation above where there is no force urging the first pin out of the fixed jaw, and thus the attachment remains held by the coupler, and the operator must take some action, such as moving the arm of the machine, to move the first pin out of the fixed jaw and finally fully remove the attachment from the coupler.

A further issue that can arise in such couplers is a destructive overload force. A hydraulic cylinder, comprising a hydraulic ram housing and piston rod, which is used as a drive means to move the second moving jaw which engages with a second coupling pin on the attachment typically itself has one end that moves to release a locking latch in the fixed jaw. For example one end of the hydraulic cylinder, typically the hydraulic ram housing, may be on trunnions which slide within grooves. This allows relative movement of the hydraulic cylinder between the fixed and the movable jaw and this allows release of the locking latch in the fixed jaw. Further retraction of the cylinder then opens the locking latch and moves the movable jaw. However if the opening movement is jammed for example if movement of the trunnions within the grooves is impeded for example by debris picked up during use of the machine, such as stone, sand, clay etc. then the hydraulic cylinder will not move to unlock the latch but the system continues to try to open the latch. This can cause an overload with potential damage to the unlocking mechanism for the latch, to the latch itself, or indeed to the hydraulic cylinder and/or the hydraulic system.

It is thus desirable to improve an alternative coupler which does not allow for unintentional release of the attachment and/or which may protect against destructive overload.

SUMMARY OF THE INVENTION

The present invention provides a quick hitch coupler for coupling an attachment to a dipper arm of a machine for example a back actor arm of a machine, the quick hitch coupler comprising:

(a) a body member adapted for coupling to the dipper arm, (b) a fixed engaging jaw mounted on the body member for engaging a first one of a pair of coupling pins mounted on the attachment, (c) a movable engaging jaw mounted on the body member for engaging a second one of the pair of coupling pins of the attachment, the movable engaging jaw being movable between an engaged state with the movable engaging jaw engaging the second coupling pin while the fixed engaging jaw engages the first coupling pin for coupling the attachment to the coupler, and a disengaged state for disengaging the second coupling pin, (d) a latch co-operable with the fixed engaging jaw for retaining the first coupling pin of the attachment engaged in the fixed engaging jaw the latch being alternately operable in a latched state co-operating with the fixed engaging jaw for retaining the first coupling pin in the fixed engaging jaw, and an unlatched state for releasing the first coupling pin from the fixed engaging jaw, (e) an urging means for urging the latch into the latched state, (f) a release block being movable on (and relative to) a guide, the release block being movable on the guide between a non-active position in which the latch remains in the latched state and an active position where the release block abuts against the latch to move the latch from the latched state to the unlatched state against the urging action of the urging means, (g) a drive means generating an amount of displacement:

(i) for moving the movable engaging jaw from the engaged state to the disengaged state, and (ii) for moving the release block on the guide from the non-active position to the active position.

Any suitable urging means may be used such as a spring.

In this arrangement the drive means is not connected to the latch. The drive means moves independently of the latch. This means that the condition set out above which causes the attachment to be unintentionally ejected cannot occur.

While displacement generated from the drive means is transmitted to the release block the movement of the release block in response can be controlled independently.

A non-active position of the release block is a non-active state where the release block is non-active in relation to moving the latch. This non-active position/state may include a range of movement of the release block. The active position is an active state where the release block is active in relation to moving the latch. This active position/state may include a range of movement of the release block.

It is desirable that the quick hitch coupler of the invention has a first stage where the drive means generates an amount of displacement for moving the movable engaging jaw but the release block is not moved and a second stage where the drive means generates an amount of displacement for moving the movable engaging jaw above a threshold amount where the release block is moved. In effect the arrangement ensure that the release block can only move the latch to an unlatched state when the movable engaging jaw is moved towards the disengaged state beyond a point at which the movable engaging jaw can engage with or against the second coupling pin. The drive means may for example extend and retract. The drive means may retract to move the movable engaging jaw from the engaged state to the disengaged state. The drive means may extend to move the movable engaging jaw from the disengaged state to the engaged state.

In prior art arrangements the movement of the movable engaging jaw and the opening of the latch were effected by forces arranged in opposite directions because opposite ends of a hydraulic ram applied force in opposite directions. The movable engaging jaw urging action (for urging the movable engaging jaw between the engaged state and the disengaged state), and the latch urging action (for urging the latch from the latched state to the unlatched state (against the urging action of the urging means)) were in opposite directions.

With the present invention in the opening sequence the actions imparted by the drive means are in the same direction. With the present invention the movable engaging jaw displacement action (for moving the movable engaging jaw between the engaged state and the disengaged state), and the release block displacement to the active position (for urging the latch from the latched state to the unlatched state (against the urging action of the urging means)) are in the same direction. This direction is suitably the direction from the movable engaging jaw towards the fixed engaging jaw.

Accordingly even if the movable engaging jaw becomes jammed before it reaches its disengaged state, the latch will not be moved to the unlatched position. This represents a substantial advance as the attachment cannot be ejected from the coupler in the manner described above. As mentioned above such jamming can occur where an actuator such as an electrical or hydraulic cylinder comprising a ram housing and a piston rod/ram, is used as a drive means to move the movable engaging jaw. The actuator may have one end that moves to retain the latch in its latched state. For example one end of the electrical or hydraulic cylinder, typically the ram housing, may be slidingly engaged within the coupler, for example on trunnions which slide within grooves. (The other end, which is typically the hydraulic rod/ram, also moves to move the movable jaw. So there is relative movement of both ends of the actuator relative to the coupler.) This allows relative movement of the cylinder between the fixed and the movable jaw and this allows blocking of release of the latch when one end of the cylinder abuts the latch. Retraction of the cylinder can then allow for the cylinder to move away from the latch and allow unlatching of the latch. Retraction of the cylinder also moves the movable jaw. However if the opening movement is jammed for example if movement of the trunnions within the grooves is impeded for example by debris picked up during use of the machine, such as stone, sand, clay etc. then the hydraulic cylinder will not move to allow unlatching of the latch. However there is no overload because even though the coupler is now operating to try to open the latch and hold the latch in a latched position at the same time the use of the release block means that any overload forces can be dissipated.

The arrangement of the invention can be considered a motion delay mechanism where the motion of the drive means is not immediately transmitted to the release block.

The quick hitch coupler of the invention may comprise attenuation means arranged to impart to the release block an amount of displacement that is attenuated relative to the amount of displacement generated by the drive means. Any suitable attenuation means may be utilized. This attenuation means can dissipate any overload in a condition where the coupler is operating to try to open the latch and hold the latch in a latched position at the same time, for example during jamming of the movement of the drive means such as an electrical or hydraulic cylinder.

For example relative to the displacement imparted to the movable engagement jaw the release block may experience a displacement which is at least 10% less such as at least 20% less, for example at least 30% less at the point at which the release block is in the active position.

A quick hitch coupler of the invention may comprise biasing means arranged to act against the displacement generated by the drive means. The biasing means may comprise at least one spring for example a compression spring.

The biasing means may during the first stage absorb the force generated by the displacement so that no force is imparted to the latch until a threshold force is reached and then in a second stage the release block is moved. Furthermore if the opening movement is jammed, potentially leading to an overload condition, as described above because the coupler is operating to try to open the latch and hold the latch in a latched position at the same time, the use of the release block together with the biasing means allows for any overload forces to be dissipated for example dissipated through the biasing means.

The attenuation means and/or biasing means may act as a motion delay mechanism to delay movement of the release block to the active position abutting the latch.

The movement of the release block is attenuated so that it displaces by a magnitude which is less than the magnitude of displacement generated by the drive means The attenuation may occur only only during the second stage.

The biasing means may act as the attenuation means to impart to the release block an amount of displacement that is attenuated relative to the amount of displacement generated by the drive means. It thus can fulfill a dual function—it can act against the displacement of the movable engaging jaw and also impart to the release block an amount of displacement that is attenuated relative to the amount of displacement generated by the drive means.

The biasing means acts a failsafe in the event of a failure in the drive means. For example if the drive means were to fail, for example due to loss of hydraulic pressure which could occur due to a rupture/leak, the biasing means still acts to bias the movable engaging jaw toward the engaged state ensuring that the attachment is still held by the movable engaging jaw.

The motion of the drive means is desirably non-rotational, for example translational.

Suitably the drive means creates a linear movement. Any suitable drive means may be employed. For example the drive means may be an extendible actuator such as a hydraulic or electrical ram.

The drive means may be an extendible actuator which instrokes in an instroke direction towards an instroked position and outstrokes in an outstroke direction towards an outstroked position.

Desirably the displacement for moving the movable engaging jaw from the engaged state to the disengaged state, and for moving the release block on the guide from the non-active position to the active position is generated by the instroke action of the extendible actuator.

Desirably the biasing means biases the movable engaging jaw toward the engaged state against the instroke action of the extendible actuator. This is a simple yet effect failsafe arrangement as set out above.

A first biasing means may be provided on a first side of the release block and a second biasing means may be provided on a second side of the release block. This allows for a very simple arrangement where the combined force of the first and second biasing means acts against the drive means and in turn biases the movable engaging jaw towards its engaged state. It however splits the biasing action on the release block in two with one biasing means arranged to bias it in one direction and the other arranged to bias in the opposite direction. Accordingly one biasing means attenuates the action of the other by opposing its action. In other words the biasing action experienced by the drive means is the sum of the biasing actions of the first and second biasing means whereas the biasing action experienced by the release block is the (lesser) net biasing action resulting from the difference between the two.

For example the second biasing means may have a greater compressive strength than the first biasing means (so as to attenuate the displacement of the release block).

As discussed herein the first and second biasing means may together act to urge the movable engaging jaw toward the engaged state against the action of the drive means.

The displacement generated by the drive means may displace the release block by imparting the displacement to the first biasing means.

The displacement generated by the drive means desirably displaces the release block by imparting the displacement to the first biasing means and the second biasing means acts as attenuation means to impart to the release block an amount of displacement that is attenuated relative to the amount of displacement generated by the drive means.

Any suitable biasing means may be used. For example the first and second biasing means may each be springs optionally compression springs. The first biasing means may comprise a pair of springs and the second biasing means may comprise a pair of springs.

The guide on which the release block is movable desirably extends from the movable engaging jaw to the fixed engaging jaw when the movable engaging jaw is the engaged state.

Suitably the guide on which the release block is movable is a rail, optionally a pair of rails.

For example the release block may have a bore defined therein and is slidingly mounted on the rail with the rail extending through the bore.

The biasing means can be any suitable means that can effect a bias and desirably comprises at least one coil spring, for example a coil compression spring. A coil spring may be mounted on the rail with the rail extending through the centre of the coil spring. This is a very simple but robust arrangement which is mechanically reliable even in tough excavation conditions.

The biasing means may comprise:

(a) a first coil spring, for example a first coil compression spring, provided on a first side of the release block and the first coil spring is mounted on the rail with the rail extending through the centre of the coil spring; and (b) a second coil spring, for example a second coil compression spring, provided on a second side of the release block and the second coil spring is mounted on the rail with the rail extending through the centre of the coil spring.

Desirably the guide on which the release block is movable is a rail and a bracket is provided on the movable engaging jaw which slides along the rail so that as the drive means generates an amount of displacement for moving the movable engaging jaw from the engaged state to the disengaged state, this displacement (by corresponding displacement of the bracket) is transmitted along the rail to the release block, and is optionally transmitted along the rail by biasing means arranged to act against the displacement generated by the drive means.

Optionally (two) parallel rails are provided with the release block mounted on both and first and second biasing means on each and a pair of brackets on the movable engaging jaw one bracket for moving along each rail.

BRIEF DESCRIPTION OF THE DRAWINGS

Embodiments of the invention will be described, by way of example only, with reference to the accompanying drawings in which.

DETAILED DESCRIPTION OF THE DRAWINGS

Figure 1:
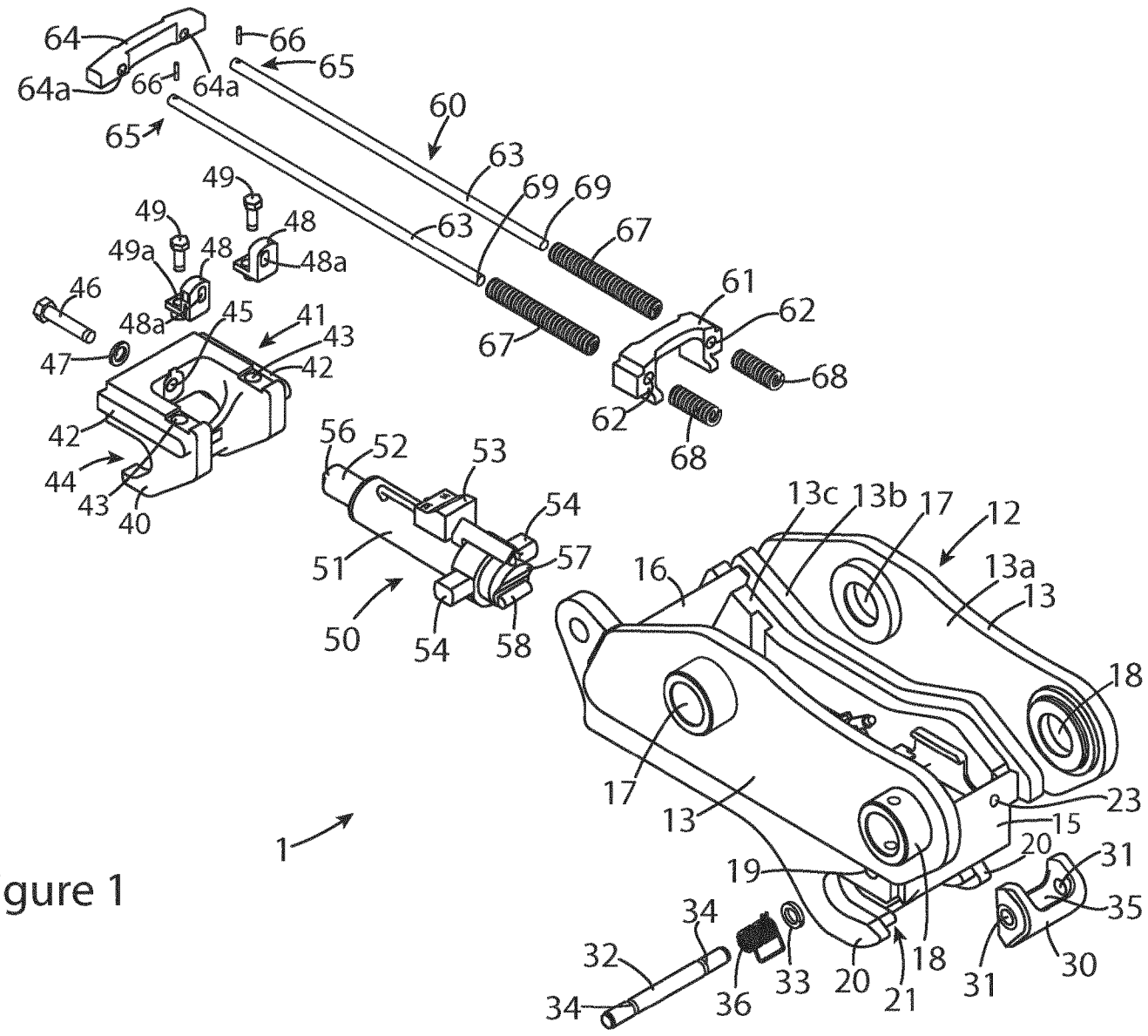
FIG. 1 is an exploded perspective view of a quick hitch coupler of the invention having a fixed engaging jaw for engaging a first one of a pair of coupling pins mounted on an attachment, and a movable engaging jaw mounted on the body member for engaging a second one of the pair of coupling pins of the attachment.

The present invention will now be described with reference to the accompanying drawings which illustrate but do not limit the invention.

With reference to FIGS. 1 to 8 a quick hitch coupler according to the invention and indicated generally by the reference numeral 1 releasably hitches an attachment in the form of a bucket 2 to the dipper arm 3. The quick hitch coupler 1 is described in detail below. The dipper arm is typically connected to a working machine such as an excavator/digger by a boom arm operated by boom operating rams. A dipper arm operating ram typically operates between the boom and the dipper arm. The movement of the quick hitch coupler 1 relative to the dipper arm 3 is controlled by a hydraulic ram. The operation of a boom and dipper arm of such earth working apparatus is well known to those skilled in the art, as is the attachment of a coupler to a dipper arm and it is not intended to describe this further.

A bushed bore extending through the dipper arm 3 at the distal end thereof accommodates a connector pin 4 for pivotally connecting the quick hitch coupler 1 to the dipper arm 3. A connector pin 5 is for connecting the quick hitch coupler 1 to an operating ram typically via a linkage.

A pair of coupling pins, namely, a first coupling pin 10 and a second coupling pin 11 are provided on the bucket 2, or indeed, on any other attachment to be connected to the dipper arm 3 for engagement with the quick hitch coupler 1 as will be described below.

The quick hitch coupler 1 of the invention comprises a body member 12 formed by a pair of spaced apart side plates 13 of steel and a transversely extending connector plate 14 (not shown in FIG. 1 for ease of showing other parts of the coupler 1) also of steel extending between the adjoining side plates 13. The side plates 13 each comprise a main side plate 13*a* and reinforcing side plates 13*b* and 13*c* welded together, however, for convenience the combination of the main and reinforcing side plates 13*a*, 13*b* and 13*c* are referred to as the side plates 13.

A pair of connector members 15 and 16 of steel plate extend between the side plates 13 at opposite ends of the side plates 13 for reinforcing the body member 12. The connector plate 14 and the connector members 15 and 16 are welded to the side plates 13.

A connecting means for connecting the quick hitch coupler 1 to a machine including a dipper arm 3 comprises a first pair of bushed bores 17 which extend through the respective side plates 13 and a second pair of bushed bores 18 which extend through the respective side plates 13. The bushed bores 17 in the side plates 13 are aligned with each other for engagement with the connector pin 5. The bushed bores 18 in the respective side plates 13 are aligned with each other for in turn alignment with the bushed bore through the dipper arm 3 for engagement with the connector pin 4. In this way the quick hitch coupler 1 can be connected to the dipper arm 3.

The side plates 13 define a pair of fixed jaws 20 for forming a fixed engaging means for engaging the first coupling pin 11 of the bucket 12. The jaws 20 define an open mouth 21 which faces outwardly of the quick hitch coupler 1 for receiving the (first) coupling pin 11.

A lock or latch 30 is pivotally mounted between the side plates 13. A pin 32 extends through bores 31 in the lock 30 and corresponding bores 19 in the side plates 13. A pair of locking rings 33 (only one shown in FIG. 1) respectively engage within grooves 34 to hold the pin 32 and lock 30 in place.

The latch 30 is pivotally carried on the pin 32. The latch 30 is urged into a latched state by urging means in the form of a (double) torsion spring 36 which is also mounted on pin 32. The torsion spring 36 acts between the latch 30 and the connector member 15.

Figure 3:
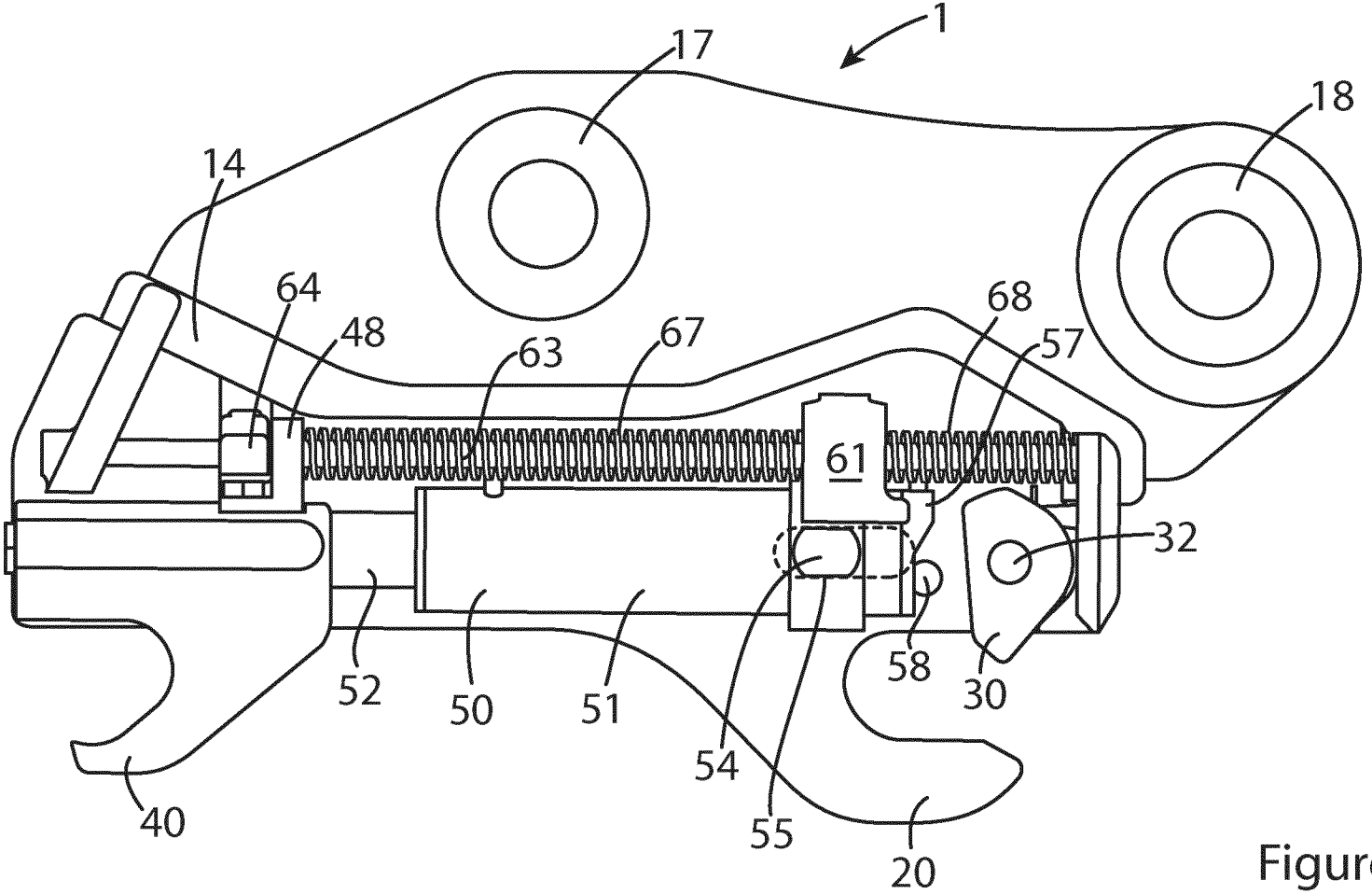
Figure 4:
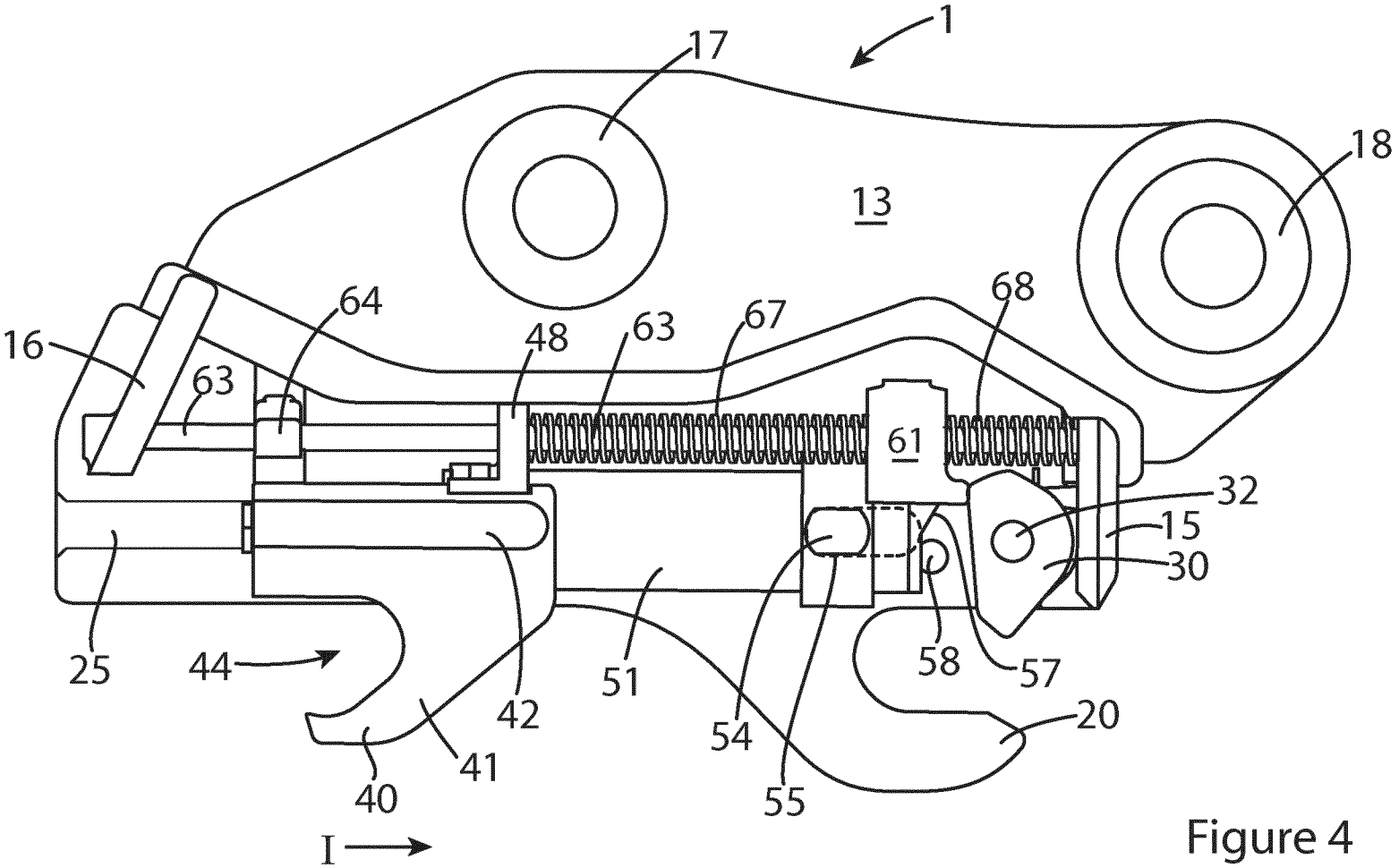
Figure 5:
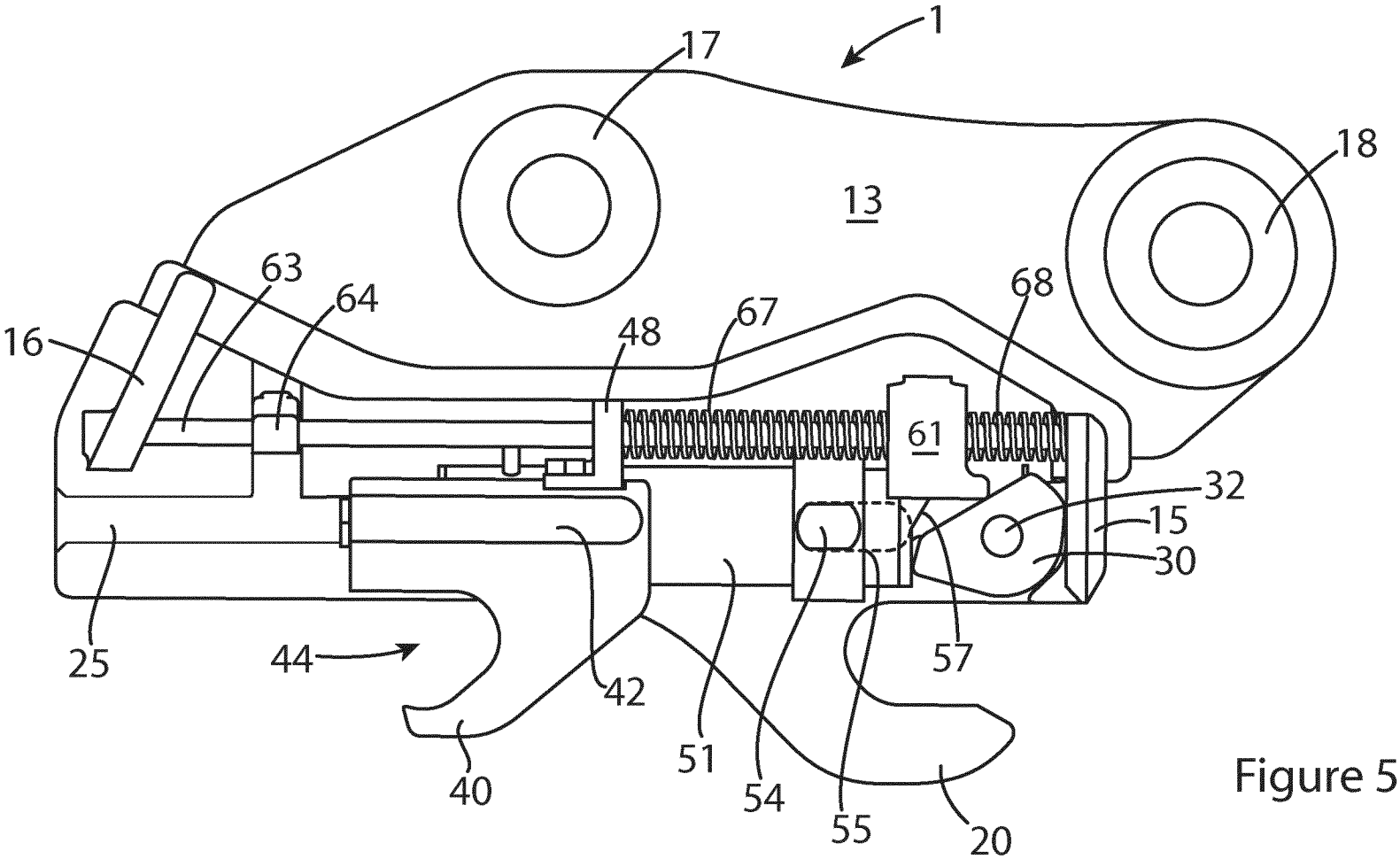

The latch 30 is pivotal between a latched state illustrated in FIGS. 2 to 4 and FIGS. 6 to 8 co-operating with the fixed jaws 20 for extending across the open mouth 21 defined by the jaws 20 for retaining the (first) coupling pin 10 within the jaws 20, and an unlatched state illustrated in FIG. 5 for releasing the first coupling pin 10 from the fixed jaws 20 through the open mouth 21. As above the torsion spring 36 urges the latch 30 toward the latched state.

A pair of movable engaging jaws 40 are provided by a movable engagement member 41 is slideably carried in the body member 12. By virtue of movement of the movable engagement member 41 the engaging jaws 40 are slideable between an engaged state illustrated in FIGS. 2 to 4 and FIGS. 6 to 8 for engaging the second coupling pin 11 of the bucket 2, and a disengaged state illustrated in FIG. 5 for disengaging the second coupling pin 11 for releasing the bucket 2 from the coupler 1. Guide tracks 42 mounted on opposite sides of the movable engagement member 41 slideably engage corresponding guide grooves on the respective inside walls of the side plates 13. This track and groove arrangement is for guiding the movable engagement member 41 and thus the fixed jaws 40 between the engaged and disengaged states with rectilinear motion.

The jaws 40 extending from the movable engagement member 41 define an open mouth 44 for accommodating the second coupling pin 11 into and between the jaws 40. The open mouth 44 faces outwardly of the coupler 1 in a direction opposite to the direction in which the open mouth 21 defined by the fixed jaws 20 faces.

Accordingly, when the movable engagement member 41 and jaws 40 are in the engaged state the first and second coupling pins 10 and 11 are securely engaged between the fixed jaws 20 and the (movable engaging) jaws 40 respectively.

A drive means of the quick hitch coupler 1 comprising a hydraulically operated double acting ram 50 acts between the movable engagement jaws 40 and the latch 30 for urging the movable engagement jaw 40 between the engaged and disengaged states, and for moving the latch 30 between the latched and the unlatched states. The coupler ram 50 comprises a ram housing 51 and a piston rod 52 extending from the ram housing 51.

A pair of trunnions 54 extending transversely from one end of the ram housing 51 slideably engage corresponding longitudinally extending guide grooves 55 in the side plates 13 for facilitating longitudinal movement of the trunnions 54, and in turn the ram housing 51 in the body member 12. An end 56 of the piston rod 52 is connected to the movable engagement jaw 40 for urging the movable engagement jaw 40 between the respective engaged and disengaged positions. In particular a locking bolt 46 with a washer 47 extends through a bore 45 in the movable engaging jaw 40 so that the locking bolt attaches the movable engaging jaw 40 to the end 56 of the piston 52.

Figure 2:
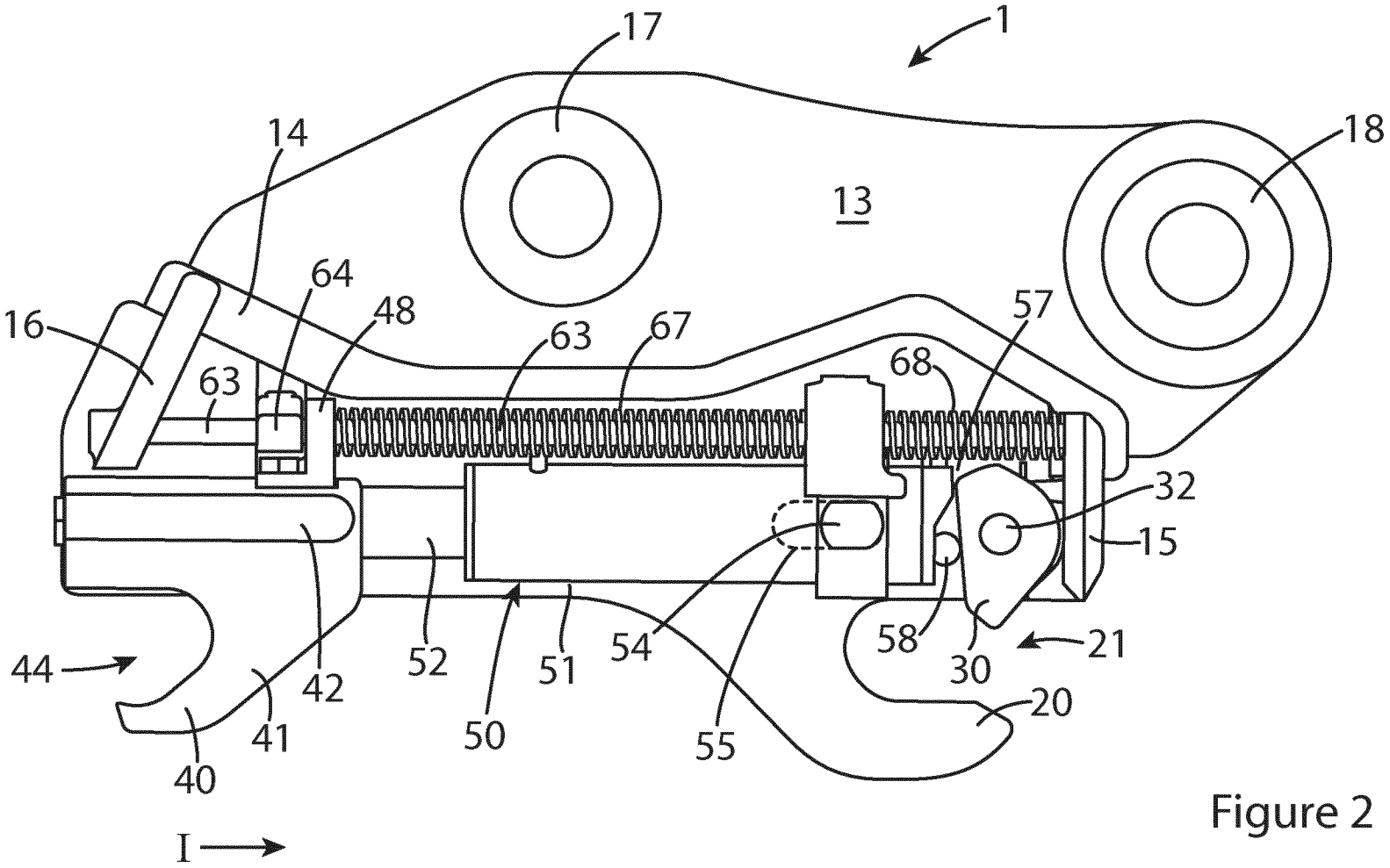
FIGS. 2 to 5 show a series of side sectional views of the quick hitch coupler of FIG. 1 moving from a working/engaged state (FIG. 2) in which it engages and retains an attachment (omitted for ease of illustration) for working the attachment and a release sequence (FIGS. 3 to 5) showing how it operates to safely release the attachment in a disengaged or release state (FIG. 5)
Figure 6:
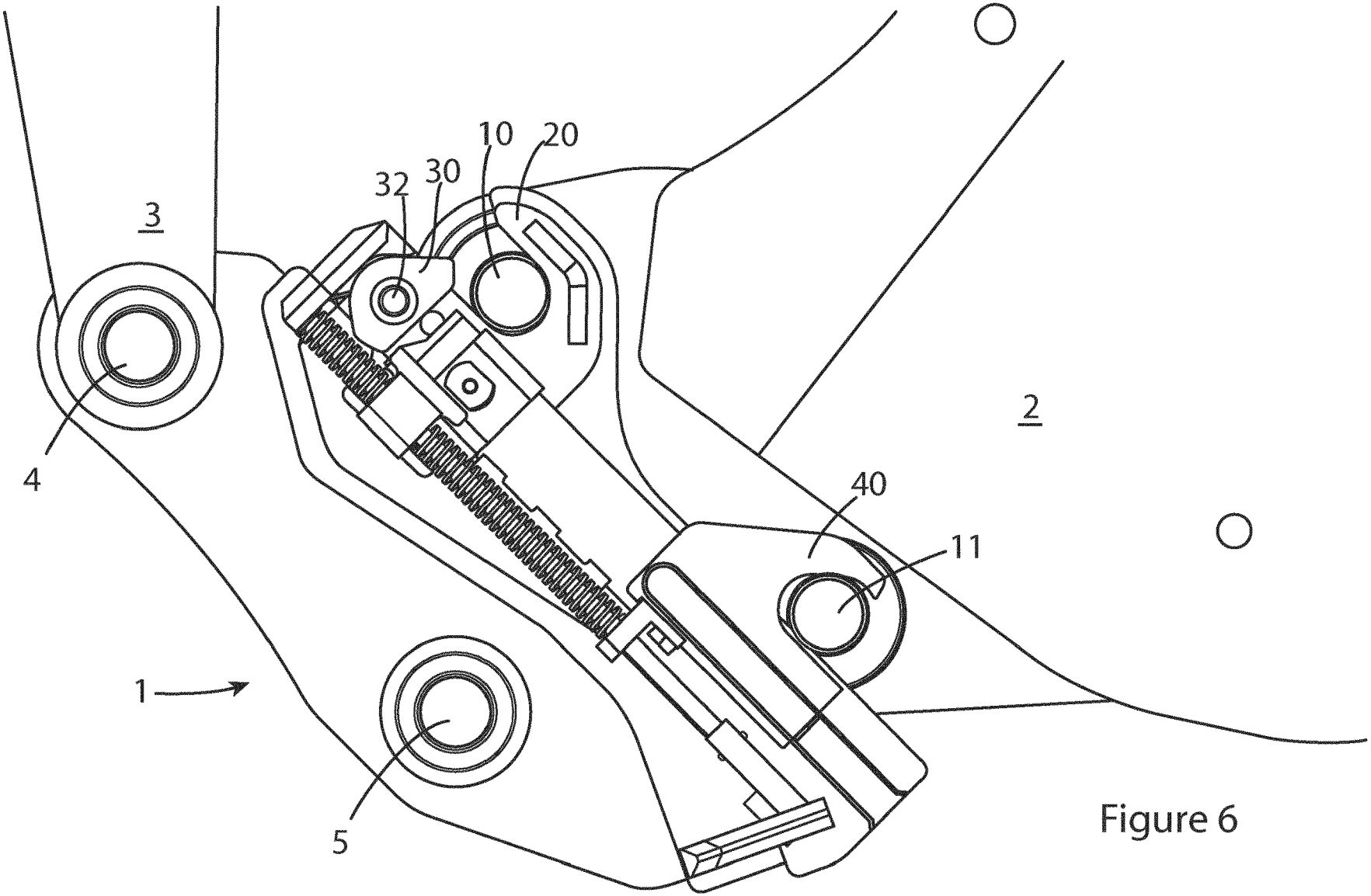
FIG. 6 shows a side view of a coupler of the invention in use attached to the dipper arm of a machine and with an attachment in the form of a bucket engaged correctly with the coupler.
Figure 8:
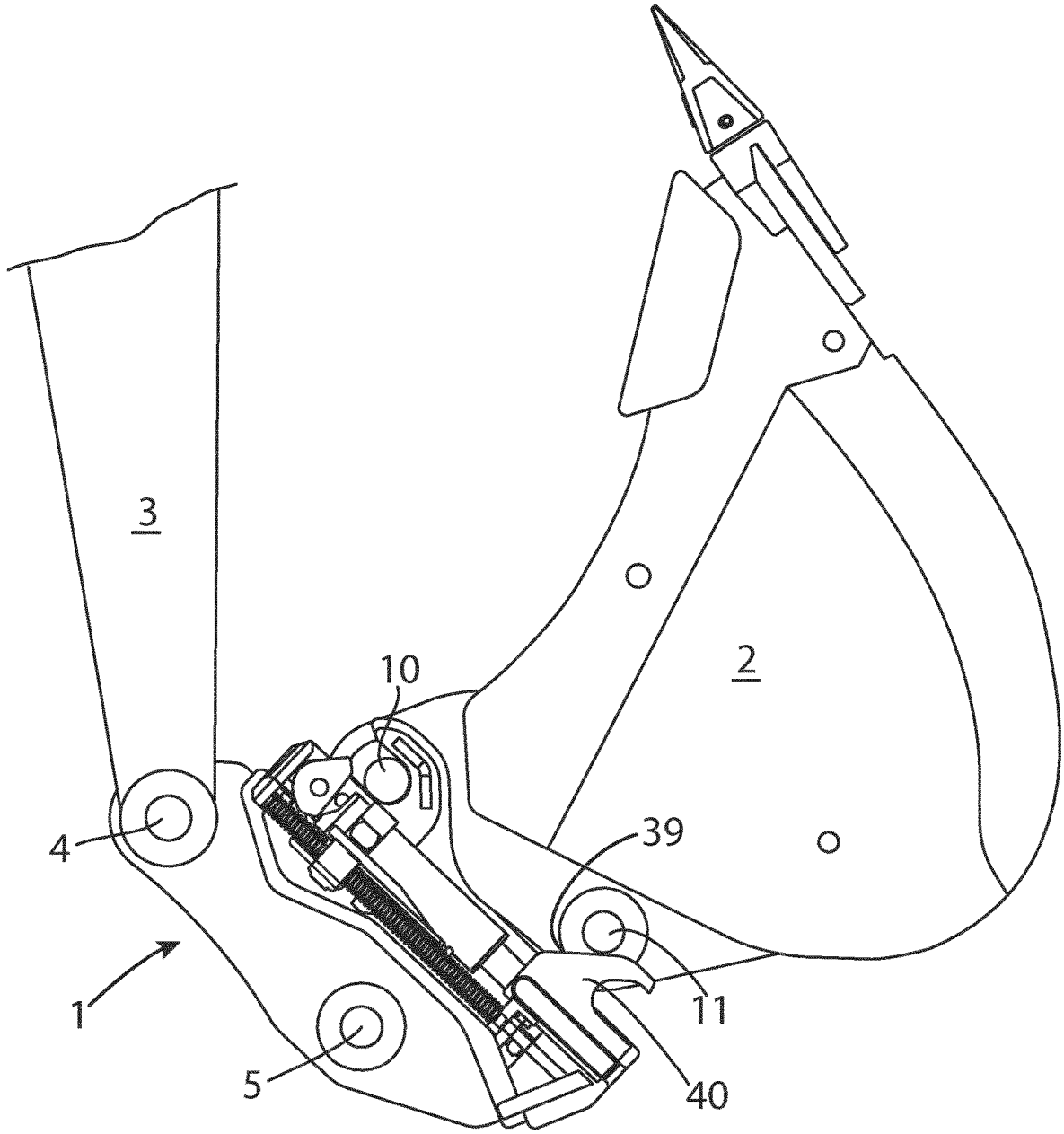
FIG. 8 shows a side view of a coupler of the invention in use attached to the dipper arm of a machine and in a crowded position with an attachment in the form of a bucket engaged only in the fixed engaging jaw and illustrating a condition in which the movable engaging jaw is moved so that the rear of the movable jaw abuts against the second pin.

On the closed end 57 of the ram housing 51 is provided a stop 58. The stop 58 abuts against the latch 30 and prevents it from opening when the ram 50 is fully extended. This position of the stop 58 abutting the latch 30 is shown in FIGS. 2, 6 and 8. The stop 58 can be designed to engage within a socket 35 of the latch 30. This aids in preventing the latch 30 from unlatching. It will be appreciated that in FIGS. 2, 6 and 8 opening of the latch 30 is prevented by the resistance of the torsion spring 36 and also by the ram 50, and in particular stop 58, which abuts the latch 30 preventing it from opening. The tension in the torsion spring 36 is sufficiently strong to retain the latch 30 in the latched state unless the latch 30 is positively urged from the latched state by the release block 61. Furthermore, as mentioned above, in the fully extended position of the ram 50 the stop 58 on the ram 50 also prevents opening of the latch 30.

The quick hitch coupler 1 of the invention further comprises a motion delay or attenuation mechanism 60 while being imparted with the latch urging action, delays transmission of the latch urging action to the latch 30. The attenuation mechanism 60 has a latch urging action imparted to it by the drive means in the form of the ram 50. In particular, a release block 61 of the attenuation mechanism 60 has a latch urging action imparted to it by the ram 50. A hydraulic port block 53 on the ram housing 51, connects to the hydraulic system of the excavator for supplying hydraulic fluid to the hydraulic ram to power it both for extension and retraction in a manner conventional for a double-acting ram.

The release block 61 is slidable relative to the body member 12 as it is provided in a sliding arrangement on a pair of (rounded) rails, 63. The rails 63 have a first end 65 which engage within and extend through respective bores 64*a* in an endstop 64.

The respective ends 65 of the rails 63 extend though respective bores 48a in respective fixing brackets 48. The fixing brackets 48 are fixed to the movable engagement jaw 40 by locking bolts 49 which extend through respective bores 49*a* and engage with bores 43 in the movable engagement jaw 40. Pins 65 hold the respective ends 65 of the rails 63 in place relative to the body member 12.

The other ends 69 of the rails extend into bores 23 in connector member 15.

In this arrangement the endstop 64 and the rails 63 remain stationary while the movable engagement jaw 40 (by means of brackets 48) and the release block 61 are also slidable back and forth along the rails 63.

Also mounted on respective rails 63 are a pair of longer compression springs 67 on the same side of the release block 61 as the movable engagement jaw 40 and a pair of shorter compression springs 69 on the same side of the release block 61 as the fixed jaws 20.

The longer compression springs 67 are on the opposite side of the release block 61 to the pair of shorter compression springs 68. Thus a first biasing means is provided on a first side of the release block 61 and a second biasing means is provided on a second side of the release block 61.

The movable release block 61 is for abutting against the latch 30 to move the latch to an unlatched state.

It will be noted that for the ram 50 to instroke towards a retracted position it must pull movable engagement jaw in an instroke direction indicated by arrow I. To do so it must compress the springs 67 and 68 as will be described in more detail below.

The attenuation mechanism 60 delays transmission of the latch urging action to the latch 30 by delaying abutment of the movable release block 61 against the latch 30.

The (reversible) sequence for releasing the bucket 2 from the quick hitch coupler 1 by moving the movable engaging jaw from an engaged state (e.g. shown in FIG. 2) with the movable engaging jaw 40 engaging the second coupling pin while the fixed engaging jaw 20 engages the first coupling pin for coupling the attachment to the coupler, and a disengaged state (e.g. shown in FIG. 5) with the movable engaging jaw 40 disengaging the second coupling pin, and the latch 30 being alternately operable in a latched state co-operating with the fixed engaging jaw 20 for retaining the first coupling pin 10 in the fixed engaging jaw 20, and an unlatched state for releasing the first coupling pin 10 from the fixed engaging jaw 20, is shown in FIGS. 2 to 5. It will be appreciated that the reverse sequence from FIG. 5 to FIG. 2 can be used to couple to the bucket 2.

In FIGS. 2 to 5 the pins 10 and 11 and the bucket 2 are omitted for ease of illustration.

In FIG. 2 the ram 50 is fully extended or outstroked. In this configuration the movable engaging jaw 40 is in its fully engaged state for engaging pin 11. Furthermore the latch 30 is in its latched state co-operating with the fixed engaging jaw 20 for retaining the first coupling pin 10 in the fixed engaging jaw 20.

The piston rod 52 is fully extended and this has caused the ram housing 51 and in particular trunnions 54 to slide within body member 12 until the end 57 of the ram housing 51 and in particular the stop 58 on the ram housing 51, engages with or against the latch 30 preventing it from rotating about pin 32 and thus preventing it from unlatching.

Furthermore the release block 61 is spaced apart from the latch 30 so it does not act upon the latch 30. The release block is thus in a passive position.

The latch 30 is also being biased toward its latch position by the torsion spring 36.

FIG. 2 shows a working configuration of the quick hitch coupler 1, a configuration where the coupler is attached to an attachment and is ready to work.

FIG. 3 shows a first stage in the sequence. In FIG. 3 the operator has initiated a quick coupler release sequence.

It will be appreciated, that, as is desirable, the operator may have to first place the coupler and attachment in a position where release is possible such as a crowded position and with the attachment on the ground. To achieve this a control system such as is described in EP1637659 to Geith International the entire contents of which are incorporated herein by reference, may be employed. This ensures that the release sequence can only be initiated when the attachment is in a safe position for release.

As can be seen from FIG. 3 in this first stage as power is transmitted to the ram 50 to instroke, the piston rod 52 retracts into the ram housing 51. This has the effect of pulling ram housing 51, and end 57 thereof with stop 58, away from latch 30 by sliding of trunnions 54 within the body member 12. Movable engaging jaw 40 remains in the position shown in FIG. 2. The latch 30 remains in its latched position because of torsion spring 36. Release block 61 remains in the position shown in FIG. 2.

As can be seen from FIG. 4 as further power is transmitted to the ram 50 to instroke, the piston rod 52 further retracts into the ram housing 51. This has the effect of pulling ram housing 51, and end 57 thereof with stop 58, further away from latch 30 until the trunnions 54 reach their limit of movement. Once trunnions 54 reach their limit of movement the ram housing 51 no longer moves and instead piston rod 52 moves by retracting into the ram housing 51. Movable engaging jaw 40 is now pulled away from the position shown in FIG. 2 as guide tracks 42 slide within the body member 12. This in turn moves brackets 48 which compress springs 67 against release block 61. In turn release block 61 compresses springs 68. The net effect is that as the piston rod 52 further retracts into the ram housing 51 release block 61 is moved along rails 63 until it becomes active and it abuts latch 30. In FIG. 4 the latch 30 remains in its latched position because of torsion spring 36. Release block 61 abuts latch 30.

As can be seen from FIG. 5 as yet further power is transmitted to the ram 50 to instroke, the piston rod 52 further retracts into the ram housing 51. Movable engaging jaw 40 is now pulled further away from the position shown in FIG. 2 as guide tracks 42 slide within grooves 25 in the body member 12. This in turn moves brackets 48 which further compress springs 67 against release block 61. In turn release block 61 further compresses springs 68. The net effect is that as the piston rod 52 further retracts into the ram housing 51 release block 61 becomes active and it is moved along rails 63 until it opens latch 30. It does so by acting against and overcoming the biasing action of torsion spring 36.

Within this sequence it is only in the configuration of FIG. 5 that an attachment can be completely released from the quick hitch coupler 1.

It will be appreciated that by reversing the sequence from FIG. 5 to FIG. 2 an attachment can be coupled to a quick hitch coupler 1 of the invention.

FIG. 6 (partially) shows coupling pins 10 and 11 of a bucket 2 coupled to a quick hitch coupler 1 of the invention which is also shown attached to a dipper arm 3. (Hydraulic cylinders/linkage for attaching to pin 5 have been omitted for ease of illustration.)

Figure 7:
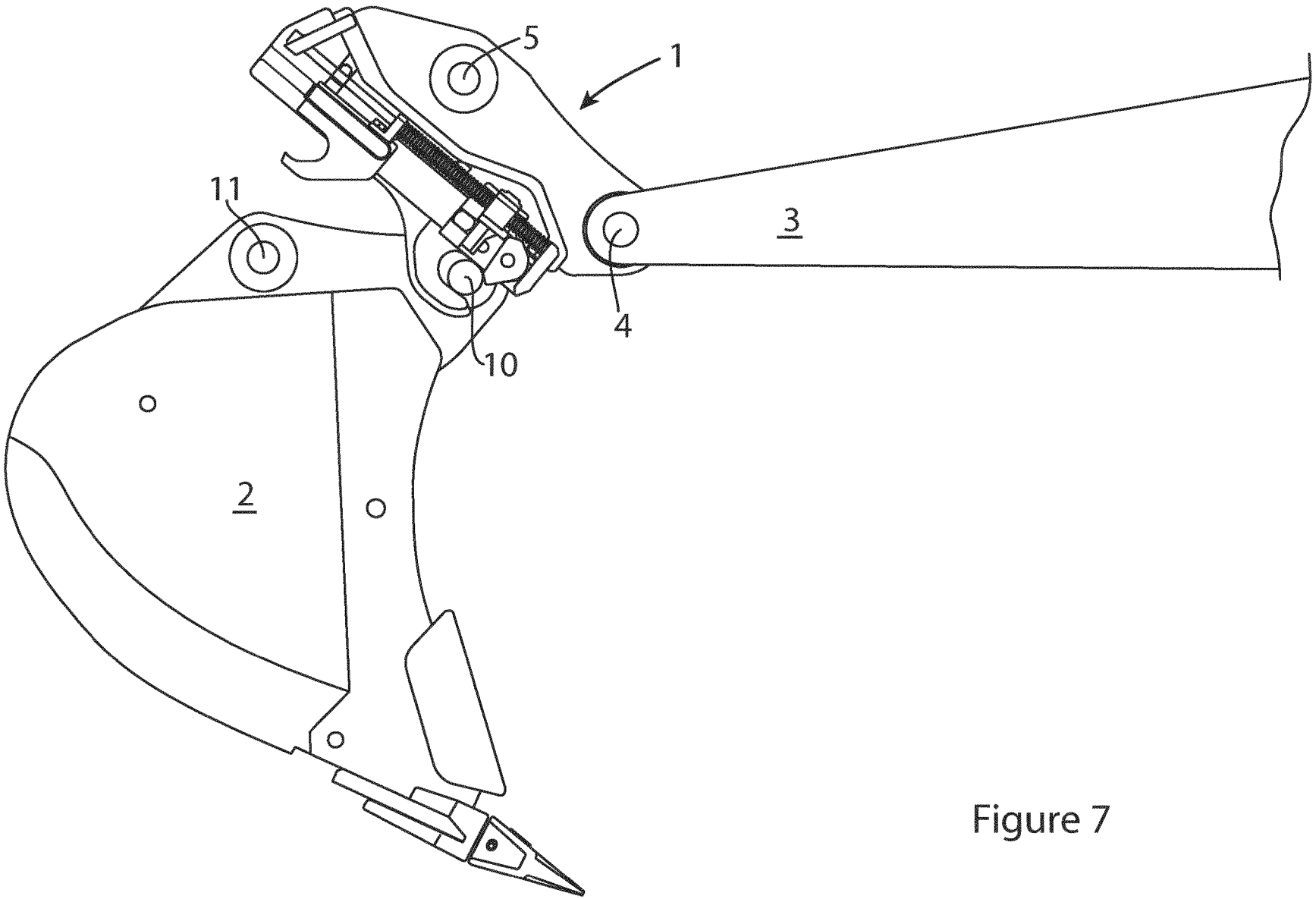
FIG. 7 shows a side view of a coupler of the invention in use attached to the dipper arm of a machine and with an attachment in the form of a bucket engaged only in the fixed engaging jaw illustrating a partially attached condition of the attachment.

FIGS. 7 and 8 show what happens when an operator unsuccessfully follows a coupling sequence. In this arrangement the operator has successfully coupled pin 10 within the fixed jaw 20. However the operator has missed pin 11 and has outstroked ram 50 to such a point that movable engaging jaw 40 has passed by pin 11. In summary the operator has missed catching the pin 11 with the movable engaging jaw 40 but movable engaging jaw 40 has now been extended too far and must be retracted in order to try again to couple to pin 11.

Because of a control system of the invention the operator must now follow a release sequence by first placing the arm and bucket/coupler in a release position as shown for example in FIG. 8.

As can be seen from FIG. 8 the pin 11 has now become trapped or engaged behind a rear side 39 of the movable engaging jaw 40. This means that as the operator instrokes the ram 50 that instead of jaw 40 retracting, jaw 40 jams in place behind pin 11 and ram housing 51 slides along as trunnions 54 slide within the body member. This is the condition described above where in the coupler of European patent EP 1637659 this can cause the ram to pull open the latch and then the force of the rear side 39 of the movable engaging jaw 40 acting against the pin 11 would push pin out of jaw 20 thus allowing the attachment to be ejected unintentionally from the coupler.

However with the quick release coupler of the present invention and even if the condition shown in FIG. 8 arises the attachment will never be ejected unintentionally in this manner as the release block will not unlatch the latch in such circumstances.

Figure 9:
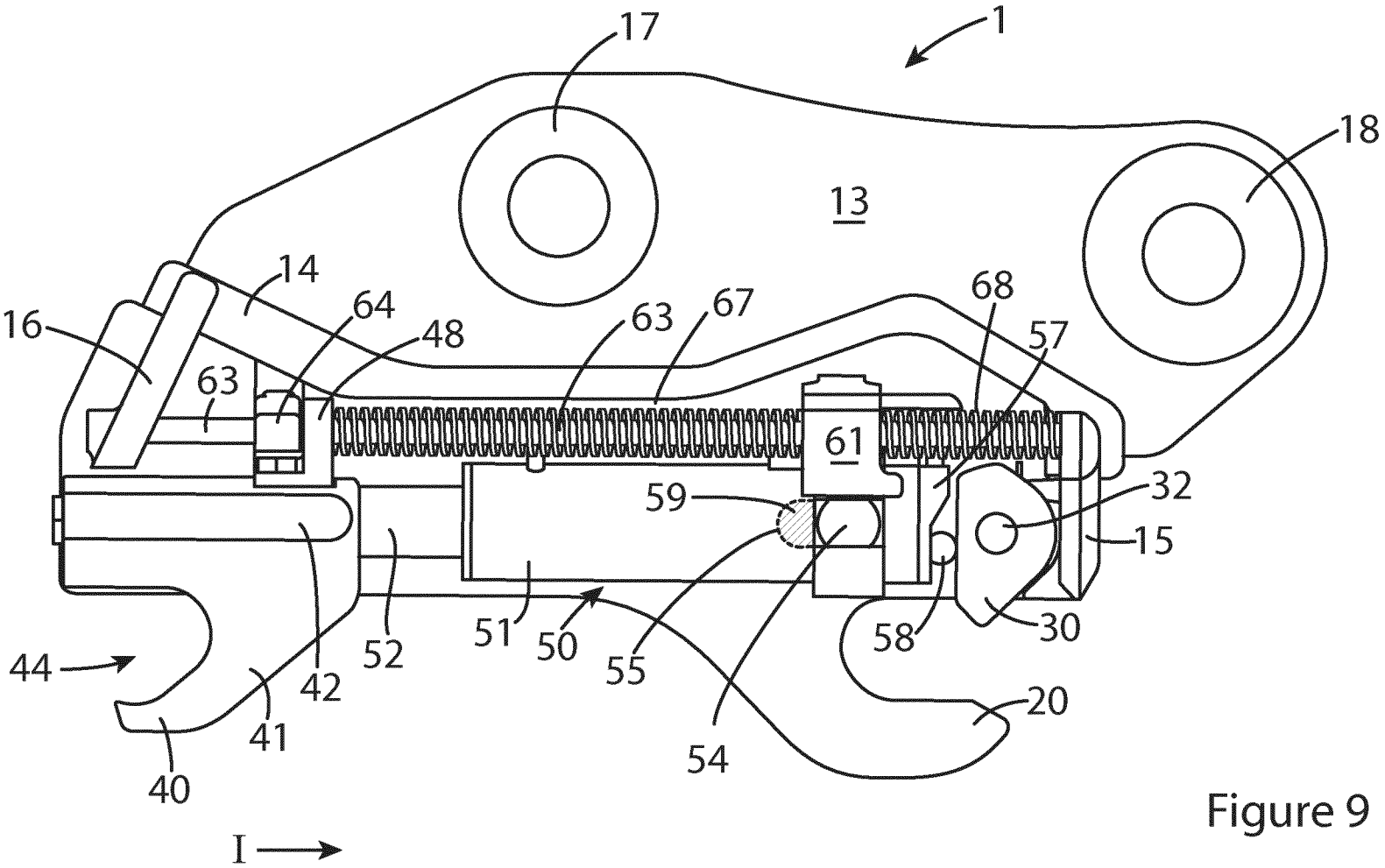
FIGS. 9 to 11 show a series of side sectional views of the quick hitch coupler of FIG. 1 moving from a working/engaged state (FIG. 9) in which it engages and retains an attachment (omitted for ease of illustration) for working the attachment and a release sequence (FIGS. 9 to 11) showing how it operates when opening movement is jammed as movement of the drive means is impeded by debris.
Figure 10:
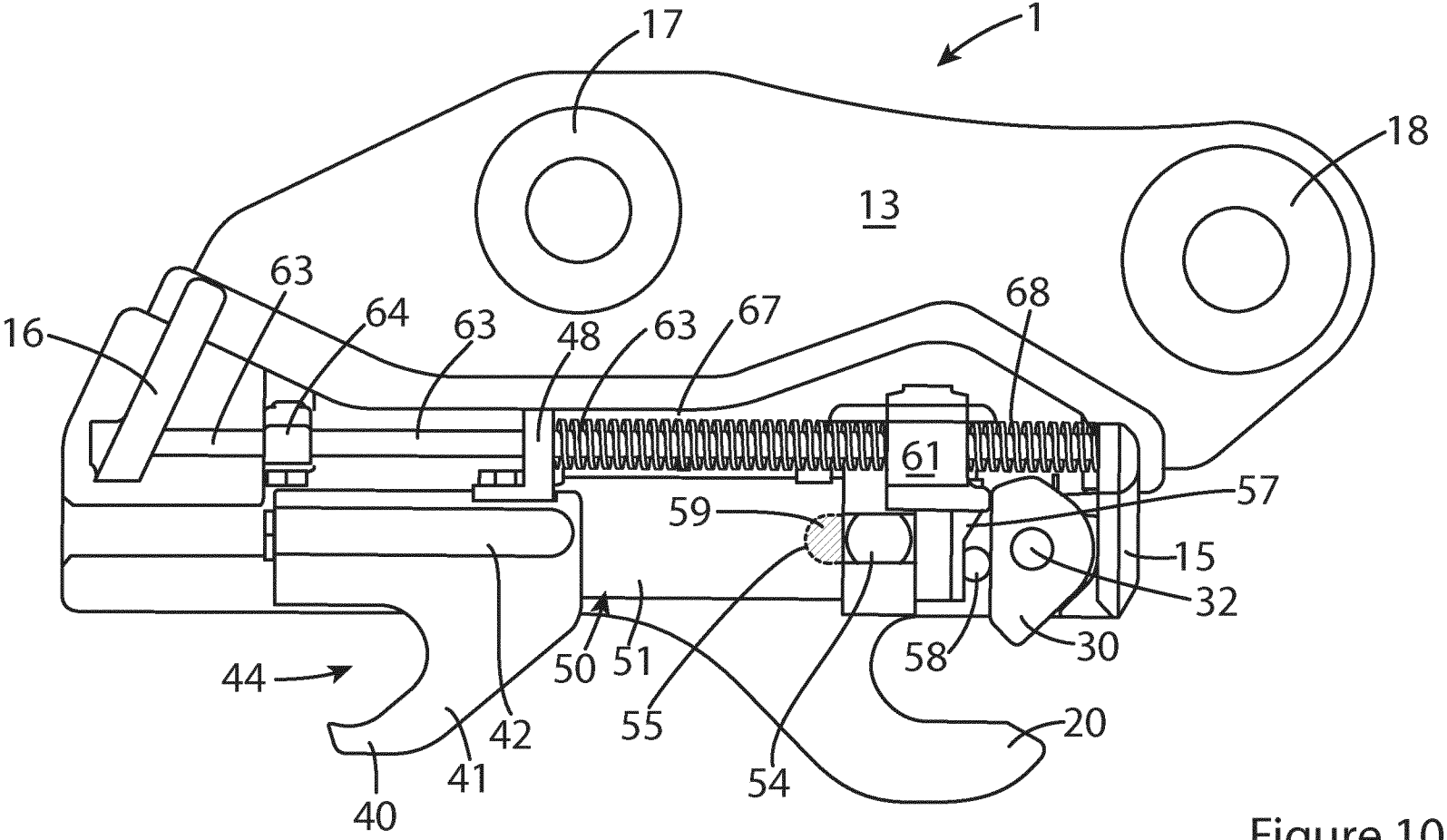
Figure 11:
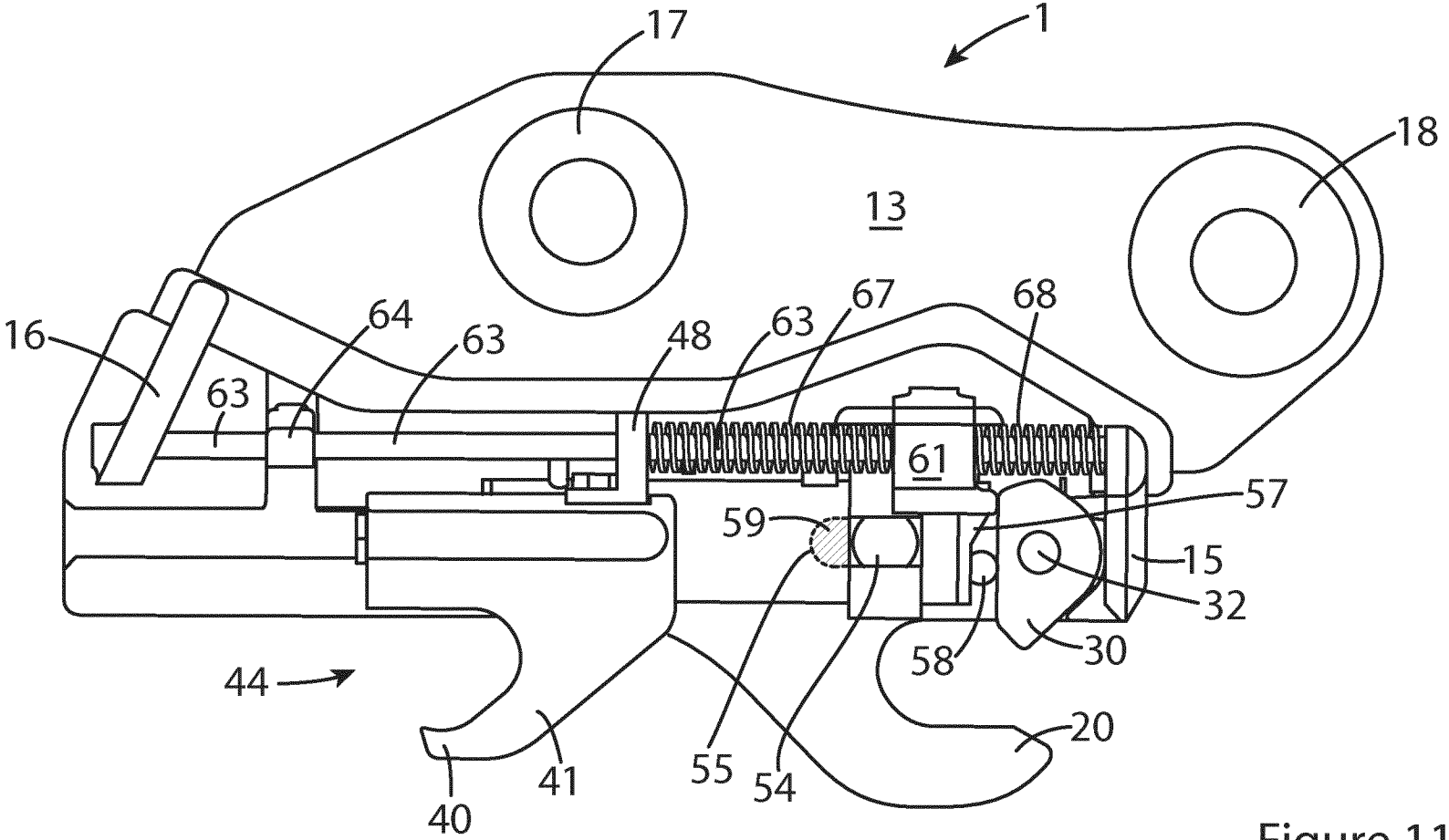

FIGS. 9 to 11 show a series of side sectional views of the quick hitch coupler 1 of FIG. 1 moving from a working/engaged state (FIG. 9) in which it engages and retains an attachment (omitted for ease of illustration) for working the attachment and a release sequence (FIGS. 10 and 11 in particular) showing how it operates when opening movement is jammed as movement of the drive means is impeded by debris.

The coupler 1 is as described above. However in this case the sequence shows what happens when the trunnions 54 can no longer move due to debris 59 (indicated by hatching) within grooves 55.

As can be seen from FIG. 10 in this first stage as power is transmitted to the ram 50 to instroke, the piston rod 52 retracts into the ram housing 51. Because of the debris 59 the effect of pulling ram housing 51, and end 57 thereof with stop 58, away from latch 30 by sliding of trunnions 54 within the body member 12 does not occur. Instead the ram housing 51 does not move and the movable engaging jaw 40 moves. (This is in contrast to the normal sequence where there is no debris, for example as shown in FIG. 2, where the movable engaging jaw 40 remains in the position shown in FIG. 2 as movement of the trunnions is allowed.) In FIG. 10 the latch 30 remains in its latched position because of torsion spring 36. Release block 61 moves toward and abuts the latch 30 as shown in FIG. 10. (Again this in contrast to the normal sequence.) Movable engaging jaw 40 has now pulled away from the position shown in FIG. 9 as guide tracks 42 slide within the body member 12. This in turn moves brackets 48 which compress springs 67 against release block 61. In turn release block 61 compresses springs 68. The net effect is that as the piston rod 52 further retracts into the ram housing 51 release block 61 is moved along rails 63 until it becomes active and it abuts latch 30. Because of the jammed condition the release block has become active earlier than would otherwise occur. Also because of the jammed condition the ram housing 51, and end 57 thereof with stop 58, stays in position abutting latch 30 and preventing it from opening.

The coupler 1 is now operating to try to open the latch 30 and hold the latch 30 in a latched position at the same time which has the potential to cause overload forces.

As can be seen from FIG. 11 as further power is transmitted to the ram 50 to instroke, the piston rod 52 further retracts into the ram housing 51. This increases the opening force being applied to the latch 30 by the release block 61 but because of the jammed condition the ram housing 51, and end 57 thereof with stop 58, stays in position abutting latch 30 and preventing it from opening.

The net result is that because of the jammed condition the latch 30 does not open so the attachment cannot be released. The opening force being applied on the latch 30 by the release block 61 is resisted by the ram housing 51, and end 57 thereof with stop 58, stays in position abutting latch 30 and preventing it from opening. The opening force could potentially cause damage trying to move the latch 30 which is locked in position. Instead because of the use of the release block the opening force can be attenuated/dissipated taken by the biasing means.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A quick hitch coupler for coupling an attachment to a dipper arm of a machine, the quick hitch coupler comprising:

a body member adapted for coupling to the dipper arm, a fixed engaging jaw mounted on the body member for engaging a first one of a pair of coupling pins mounted on the attachment, a moveable engaging jaw mounted on the body member for engaging a second one of the pair of coupling pins of the attachment, the moveable engaging jaw being moveable between an engaged state with the moveable engaging jaw engaging the second coupling pin while the fixed engaging jaw engages the first coupling pin for coupling the attachment tothe coupler, and a disengaged state for disengaging the second coupling pin, a latch co-operable with the fixed engaging jaw for retaining the first coupling pin of the attachment engaged in the fixed engaging jaw the latch being alternately operable in a latched state co- operating with the fixed engaging jaw for retaining the first coupling pin in the fixed engaging jaw, and an unlatched state for releasing the first coupling pin from the fixed engaging jaw, an urging means for urging the latch into the latched state, a release block being moveable on and relative to a guide, the release block being moveable on the guide between a non-active position in which the latch remains in the latched state and an active position where the release block abuts against the latch to move the latch from the latched state tothe unlatched state against the urging action of the urging means, first and second biasing means mounted on the guide on opposing sides of the release block; and a drive means generating an amount of displacement:

for moving the moveable engaging jaw from the engaged state tothe disengaged state, and for moving the release block on the guide from the non-active position to the active position.

2. A quick hitch coupler according to claim 1 having a first stage where the drive means generates an amount of displacement for moving the moveable engaging jaw but the release block is not moved and a second stage where the drive means generates an amount of displacement for moving the moveable engaging jaw above a threshold amount where the release block is moved.

3. A quick hitch coupler according to claim 1 comprising attenuation means arranged to impart to the release block an amount of displacement that is attenuated relative to the amount of displacement generated by the drive means.

4. A quick hitch coupler according to claim 1 wherein the first and second biasing are means arranged to act against the displacement generated by the drive means.

5. A quick hitch coupler according to claim 4 wherein the first and second biasing means act as attenuation means to impart to the release block an amount of displacement that is attenuated relative to the annount of displacement generated by the drive means.

6. A quick hitch coupler according to claim 1 wherein the drive means is an extendible actuator which instrokes in an instroke direction towards an instroked position and outstrokes in an outstroke direction towards an outstroked position, and wherein the displacement for moving the moveable engaging jaw from the engaged state to the disengaged state, and for moving the release block on the guide from the non-active position to the active position is generated by the instroke action of the extendible actuator.

7. A quick hitch coupler according to claim 6 wherein biasing means biases the moveable engaging jaw toward the engaged state against the instroke action of the extendible actuator.

8. A quick hitch coupler according to Claim 1 wherein the second biasing means has a greater compressive strength than the first biasing means so as to attenuate the displacement of the release block.

9. A quick hitch coupler according to claim 8 wherein the displacement generated by the drive means displaces the release block by imparting the displacement to the first biasing means and the second biasing means acts as attenuation means to impart to the release block an amount of displacement that is attenuated relative to the amount of displacement generated by the drive means.

10. A quick hitch coupler according to Claim 1 wherein the first and second biasing means together act to urge the moveable engaging jaw toward the engaged state against the action of the drive means.

11. A quick hitch coupler according to Claim 1 wherein the displacement generated by the drive means displaces the release block by imparting the displacement to the first biasing means.

12. A quick hitch coupler according to Claim 1 wherein the first biasing means comprises a pair of springs and the second biasing means comprises a pair of springs.

13. A quick hitch coupler according to claim 1 wherein the guide on which the release block is moveable extends from the moveable engaging jaw to the fixed engaging jaw when the moveable engaging jaw is in the engaged state.

14. A quick hitch coupler according to claim 1 wherein the guide on which the release block is moveable is a rail.

15. A quick hitch coupler according to claim 14 wherein the release block has a bore defined therein and is slidingly mounted on the rail with the rail extending through the bore, optionally wherein the release block has two bores defined therein and is slidingly mounted on a pair of rails with the rails extending through respective bores.

16. A quick hitch coupler according to claim 14 wherein the release block has a bore defined therein and is slidingly mounted on the rail with the rail extending through the bore.

17. A quick hitch coupler according to claim 14 wherein the first and second biasing means comprises at least one first and second coil spring, respectively, and the coil springs are mounted on the rail with the rail extending through the centre of the coil springs.

18. A quick hitch coupler according to claim 17 wherein the first coil spring comprises a first coil compression spring, provided on a first side of the release block and the first coil spring is mounted on the rail with the rail extending through the centre of the coil spring; and the second coil spring comprises a second coil compression spring, provided on a second side of the release block and the second coil spring is mounted on the rail with the rail extending through the centre of the coil spring.

19. A quick hitch coupler according to claim 1 wherein the guide on which the release block is moveable is a rail and a bracket is provided on the moveable engaging jaw which slides along the rail so that as the drive means generates an amount of displacement for moving the moveable engaging jaw from the engaged state to the disengaged state, this displacement is transmitted along the rail to the release block, and is optionally transmitted along the rail by biasing means arranged to act against the displacement generated by the drive means.

* * * * *